US010062394B2

(12) United States Patent
Zamir

(10) Patent No.: US 10,062,394 B2
(45) Date of Patent: Aug. 28, 2018

(54) VOICE BAND DETECTION AND IMPLEMENTATION

(71) Applicant: BOSE CORPORATION, Framingham, MA (US)

(72) Inventor: Lee Zamir, Framingham, MA (US)

(73) Assignee: BOSE CORPORATION, Framingham, MA (US)

( * ) Notice: Subject to any disclaimer, the term of this patent is extended or adjusted under 35 U.S.C. 154(b) by 25 days.

(21) Appl. No.: 14/674,493

(22) Filed: Mar. 31, 2015

(65) Prior Publication Data

US 2016/0293182 A1 Oct. 6, 2016

(51) Int. Cl.

| | |
|---|---|
| ***G10L 21/06*** | (2013.01) |
| ***G10L 21/10*** | (2013.01) |
| *G10L 25/78* | (2013.01) |

(52) U.S. Cl.

CPC ..... *G10L 21/10* (2013.01); *G10L 25/78* (2013.01); *G10L 2021/105* (2013.01)

(58) Field of Classification Search

CPC ..... G10L 21/10; G10L 25/78; G10L 25/81; G10L 25/783; G10L 25/786; F21V 23/003; F21V 23/00

USPC ..... 704/275–276, 225, 211, 260; 352/98–120

See application file for complete search history.

(56) References Cited

U.S. PATENT DOCUMENTS

| | | | | |
|---|---|---|---|---|
| 5,870,170 | A * | 2/1999 | Pope | G09F 19/12 352/101 |
| 2003/0040916 | A1* | 2/2003 | Major | G10L 21/06 704/276 |
| 2004/0068410 | A1* | 4/2004 | Mohamed | G10L 21/06 704/276 |
| 2004/0077264 | A1* | 4/2004 | Walker | A63H 33/26 446/175 |
| 2009/0044112 | A1* | 2/2009 | Basso | G06T 13/205 715/706 |
| 2010/0053557 | A1* | 3/2010 | Barnett | G03B 25/00 352/101 |
| 2011/0012503 | A1* | 1/2011 | Jackson | B44F 7/00 313/483 |
| 2013/0162951 | A1* | 6/2013 | Buyssens | G03B 25/00 352/102 |
| 2016/0295156 | A1* | 10/2016 | Zamir | G09F 19/12 |

FOREIGN PATENT DOCUMENTS

| | | | | |
|---|---|---|---|---|
| GB | 1139711 A * | 1/1969 | | G01L 3/16 |

* cited by examiner

*Primary Examiner* — Vincent Rudolph
*Assistant Examiner* — Stephen Brinich
(74) *Attorney, Agent, or Firm* — Patterson + Sheridan, LLP

(57) ABSTRACT

A system encourages experimentation with audio frequency and speaker technologies while causing an inanimate object to appear to lip-sync. The system applies a bandpass filter to an incoming audio stream to determine a magnitude of audio content in a frequency band of interest. For example, the system may filter results directed at the voice band, associated with speech. A controller controls a strobe light to flash at a particular point of travel of a platform reciprocating at a known frequency. An illusion is created that a sculpture, such as a piece of paper formed into a ring, is lip-synching to music.

20 Claims, 6 Drawing Sheets

VOICE BAND DETECTION AND IMPLEMENTATION

I. FIELD OF THE DISCLOSURE

The present disclosure relates generally to sound production assemblies, and more particularly, audio demonstration and experimentation kits, including components thereof.

II. BACKGROUND

With the increase in prevalence of mobile computing devices, children are being introduced to computing technology at a younger age. For example, it is common for a child to be proficient in operating a mobile phone or a tablet computer. It is desirable to encourage children's interest and familiarity with aspects of audio, video, and communications technologies.

III. SUMMARY

In one implementation, a system includes a strobe light, and a controller in communication with the strobe light. The controller initiates sensing a magnitude of a voice band portion of an audio signal. The controller further causes the strobe light to flash in response to sensing the magnitude.

In another example, a system includes a platform to move in a reciprocal manner, and a strobe light to flash in a direction of the platform. A controller is in communication with the strobe light. The controller determines when to flash the strobe light based on at least one of a magnitude of a measurement of an audio signal and position of the platform.

In another example, a system includes a strobe light to flash in a direction of a figure having a flexible surface. A controller is in communication with the strobe light. The controller determines when to flash the strobe light based on a magnitude of a measurement of an audio signal.

Other features, objects, and advantages will become apparent from the following detailed description and drawings.

IV. BRIEF DESCRIPTION OF THE DRAWINGS

V. DETAILED DESCRIPTION

A system encourages experimentation with audio frequency and speaker technologies while causing an inanimate object to appear to lip-sync. The system applies a bandpass filter to an incoming audio stream to determine a magnitude of audio content in a frequency band of interest. For example, the system may filter results directed at the frequency band associated with speech (i.e., the voice band). A controller controls a strobe light to flash at a particular point of travel of a shaker platform reciprocating at a known frequency. An illusion is created that a sculpture (e.g., a piece of paper formed into a ring) is lip-synching to music.

In one implementation, a strobe light is popped when the shaker platform is at its lowest point. The strobe light is also popped when there is no or little audio content in the frequency band of interest. Similarly, the strobe light is popped at a midpoint of the travel of the shaker platform when there is a moderate amount of audio content in the frequency band of interest. Another strobe flash is coincident with a high point of the shaker platform, e.g., when there is a high level of audio content in the frequency band of interest. The movement and strobe action creates the impression that a mouth of a figure is open when audio content is present and closed with the audio is not.

Figure 1:
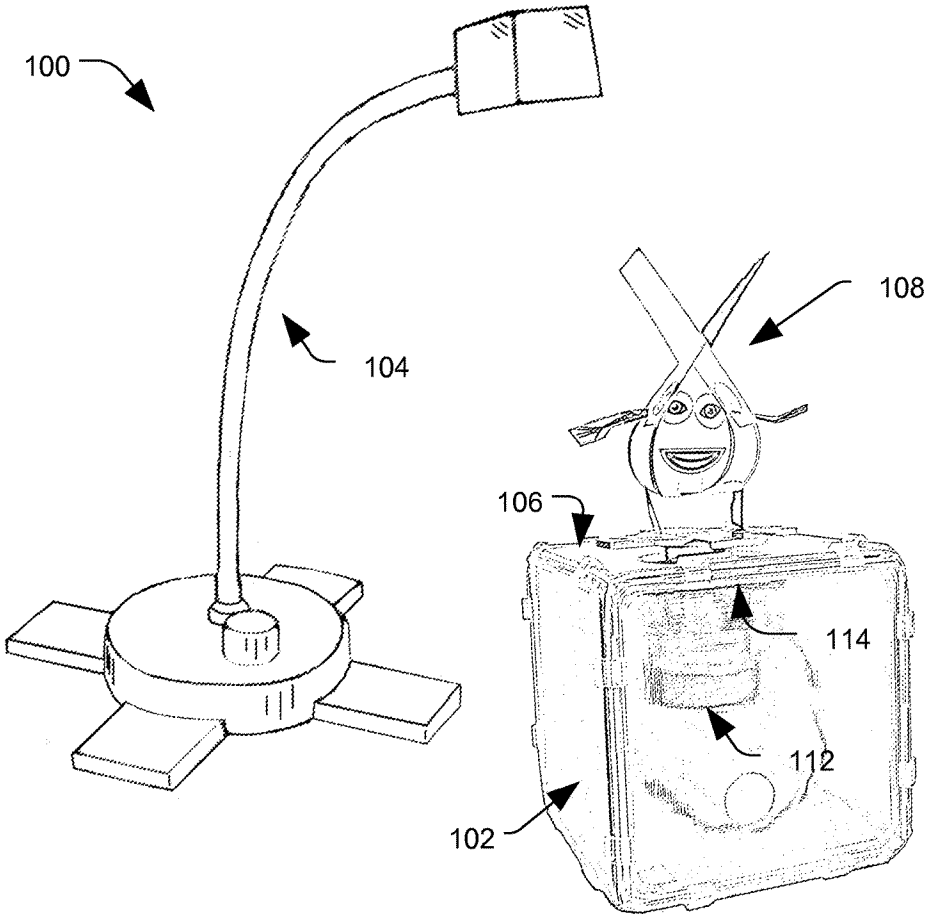
FIG. 1 illustrates a perspective view of an audio demonstration system that includes an audio production system and a strobe light.

FIG. 1 illustrates a perspective view of an audio demonstration system 100 that includes an audio production system 102 and a strobe light 104. A platform surface 106 of the audio system reciprocates in synchronization with the flashes of the strobe light 104 to create an illusion that a figure 108 is lip-synching.

The audio production system 102 includes a magnet speaker assembly 112 that causes a diaphragm 114 to vibrate according to a received audio signal. The audio signal is bandpass filtered to allow only those frequencies of the audio signal that are audible range to a human ear (i.e., the voice band, around 20 Hz to around 20 KHz). The diaphragm physically communicates those vibrations to the figure 108. The figure 108 is flexible and moves in response to the reciprocating movement of the diaphragm 114 of the platform surface 106. The strobe light 104 flashes according to the motion of the platform surface 106 to visually capture a succession of movements of the figure 108. In this manner, the action of the strobe light 104, the platform surface 106, and the figure 108 are all synchronized to the filtered audio signal.

Figure 2:
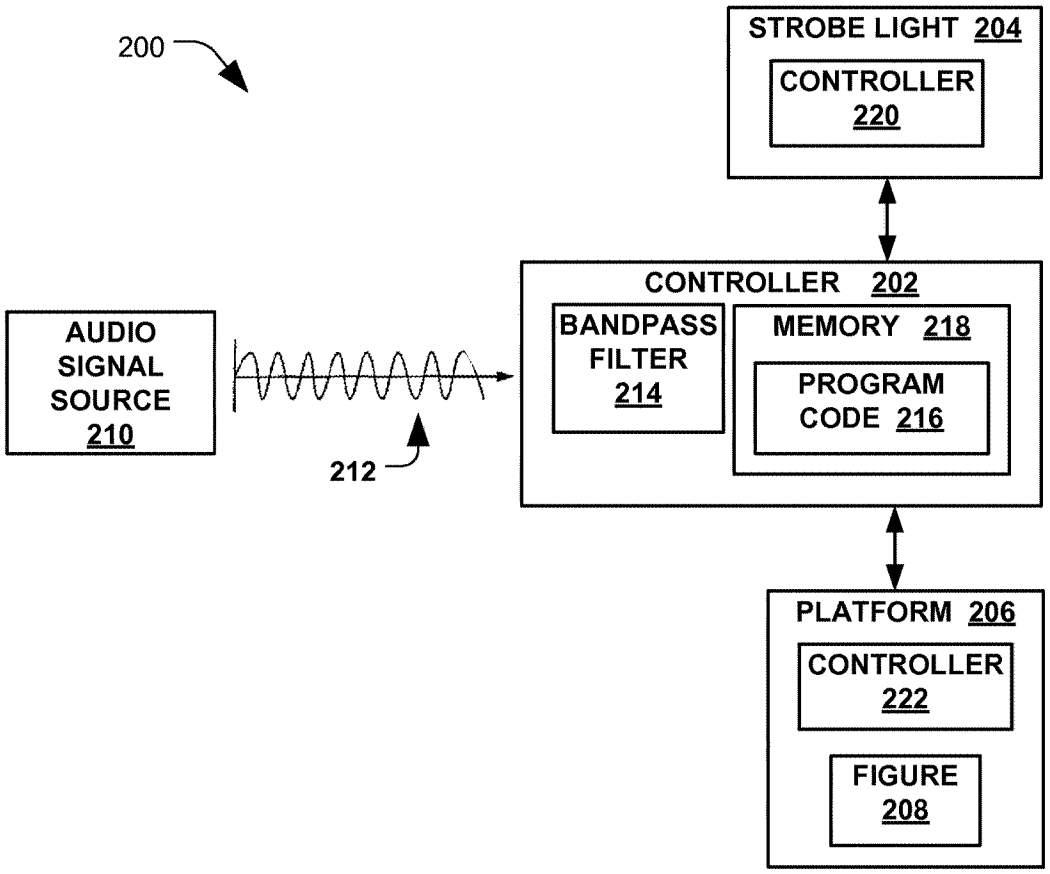
FIG. 2 is a block diagram of an audio system that includes a controller in communication with a strobe light and a reciprocating platform.

FIG. 2 is a block diagram of an audio system 200 that includes a controller 202 in communication with a strobe light 204 and a reciprocating platform 206. The controller 202 synchronizes flashes of the strobe light 204 with movement of the platform 206. The synchronization creates an illusion of lip-synching by a figure 208 positioned on the platform 206.

The controller 202 uses an audio signal from an audio signal source 210 to coordinate action between the strobe light 204 and a reciprocating platform 206. An illustrative audio signal source 210 includes an MP3 player, a radio, a telephone, a computer, and a satellite feed, among others. The connection to the controller 202 may be wired or wireless. A full spectrum audio signal 212 is downloaded or otherwise received by the controller 202. A bandpass filter 214 is used to reject frequencies of the received audio signal that fall outside of the voice band (i.e., lower than around 20 Hz and higher than around 20 KHz).

The controller 202 executes program code 216 stored in a memory 218 to designate and monitor for threshold magnitudes in the filtered audio signal. The threshold magnitudes of an example include designated amplitudes selected to create an optimal effect of lip-synchronization. For instance, the amplitudes corresponding to the most extreme points of travel of the platform are selected for maximum exaggerative effect. Intermediary points are selected as threshold magnitudes to further round out a perceived lip movement illusion. When a threshold magnitude is determined by the controller 202, the controller 202 causes the strobe light 204 to pop, or briefly illuminate.

The controller 202 shown in FIG. 2 communicates the audio signal to the platform 206. A platform in another example alternatively or additionally receives the audio signal directly from an audio source.

The platform 206 includes a substantially planar surface so that the figure 208 rests upon it. The platform 206 of another example has a non-planar surface to which the figure 208 is removably or permanently attached. The figure 208 includes pliable or flexible material, such as paper, coiled metal or plastic, and rubber.

The frequency at which the platform 206 reciprocates is known to the controller 202. For example, the platform 206 may be actuated by the frequencies inherent to the audio signal. Such actuation occurs where the platform 206 is in contact with or comprises part of a speaker assembly. The controller 202 may determine and store correlations between the magnitude of the audio signal at a given point in time and the corresponding position of the platform 206. For instance, a peak magnitude may correspond to the platform 206 being at its highest point of travel relative to a table top or other base structure. The controller 202 may use this information when determining when to pop the strobe light 204.

In an alternative implementation, the platform oscillates to a frequency that differs from the audio signal. For instance, the platform could include a shaker table that reciprocates at a steady frequency. In such a scenario, the controller pops the strobe light when a threshold magnitude of the audio signal coincides with a known and desired position of the platform. For example, the strobe light is illuminated when a peak in the audio signal is detected at the same time that the independently oscillating platform is close to its highest point of travel.

While a centralized controller 202 is shown in the block diagram of FIG. 2, one skilled in the art will appreciate that the functions of the controller 202 could be divided and augmented by controllers 220, 222 distributed throughout the system 200. Further, the controller 202 could be integrated in a device with one or all of the other components 204, 206, 210 of the system 200.

Figure 3:
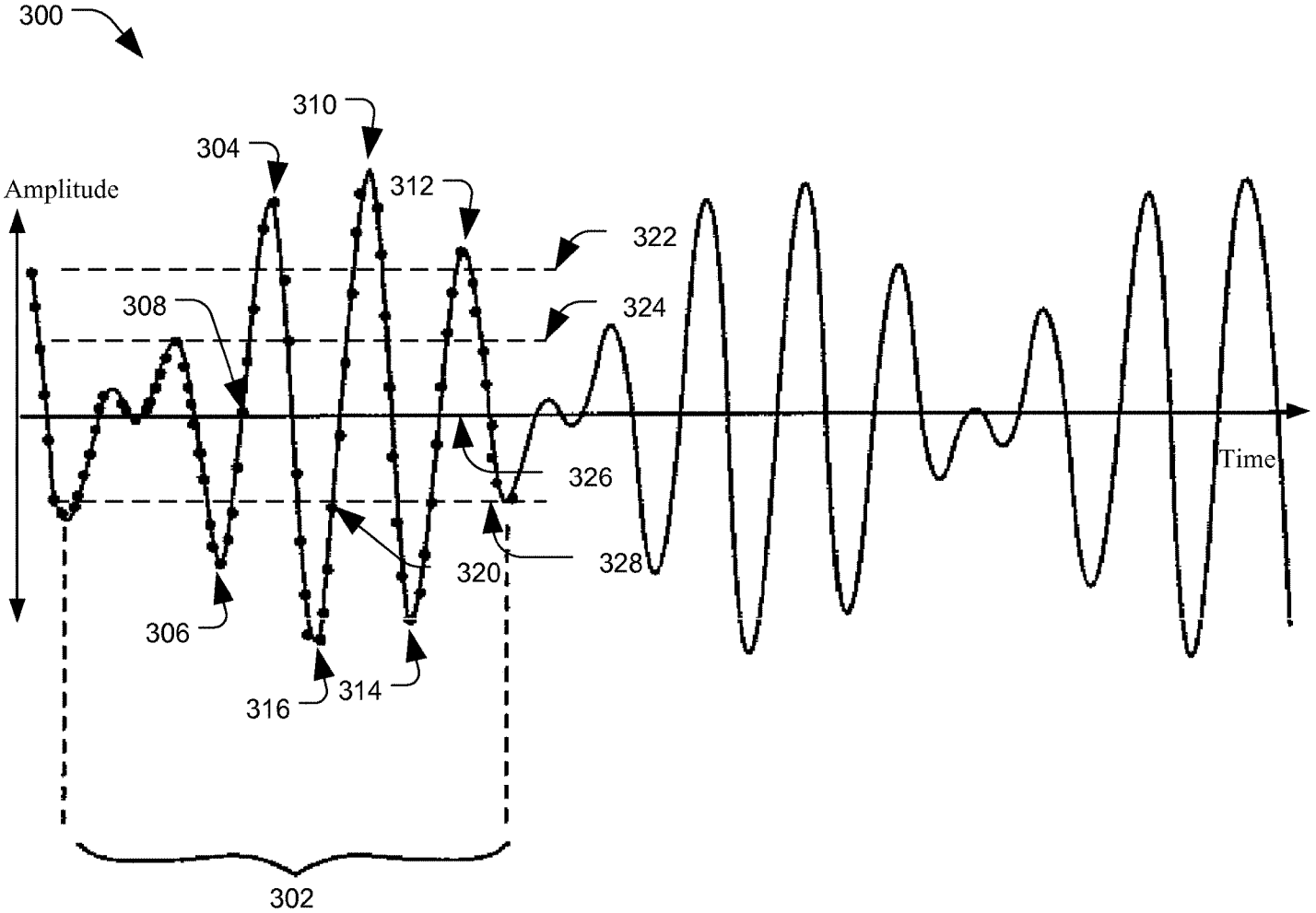
FIG. 3 illustrates a voice band signal, such as is used by the controller of FIG. 2 to determine threshold magnitudes.

FIG. 3 illustrates a voice band audio signal 300, such as is used by the controller 202 of FIG. 2 to determine threshold magnitudes. The threshold magnitudes, in turn, are used as queues to initiate strobe flashes.

A first envelope 302 of the audio signal 300 is sampled, as denoted by the dots plotted as amplitude over time. The first envelope 302 may correspond to a short, spoken phrase, "Hello. My name is Lee." Some of the sampled points are designated by a controller as threshold magnitudes 304, 306, 308, 310, 312, 314, 316, 318.

When a threshold magnitude is detected, the controller causes the strobe light to flash. The threshold magnitudes correspond to points of travel of the platform. For instance, a threshold magnitude 304 (corresponding to a peak in amplitude) is associated with a highest point of travel of the platform. Another threshold magnitude 308 (associated with relatively little amplitude) is associated with relatively low position of the platform. Still another threshold magnitude 318 is logically linked to a midpoint. The controller uses the associations to initiate strobe flashes at designated (e.g., extreme and midway) points of travel of the platform to create a desired effect. For instance, the amplitudes corresponding to the most extreme points of travel of the platform are selected for maximum exaggerative effect. Intermediary points are selected as threshold magnitudes to further round out a perceived lip movement illusion.

In one implementation, threshold magnitudes are determined whenever an audio curve crosses a predetermined magnitude level, as denoted by the dashed, parallel lines 322, 324, 326, 328. In an example, the threshold magnitudes are predetermined. In another implementation, the controller uses comparative or fuzzy logic to determine the threshold magnitude based on relative change in amplitude relative to a previous signal measurement.

Figure 4:
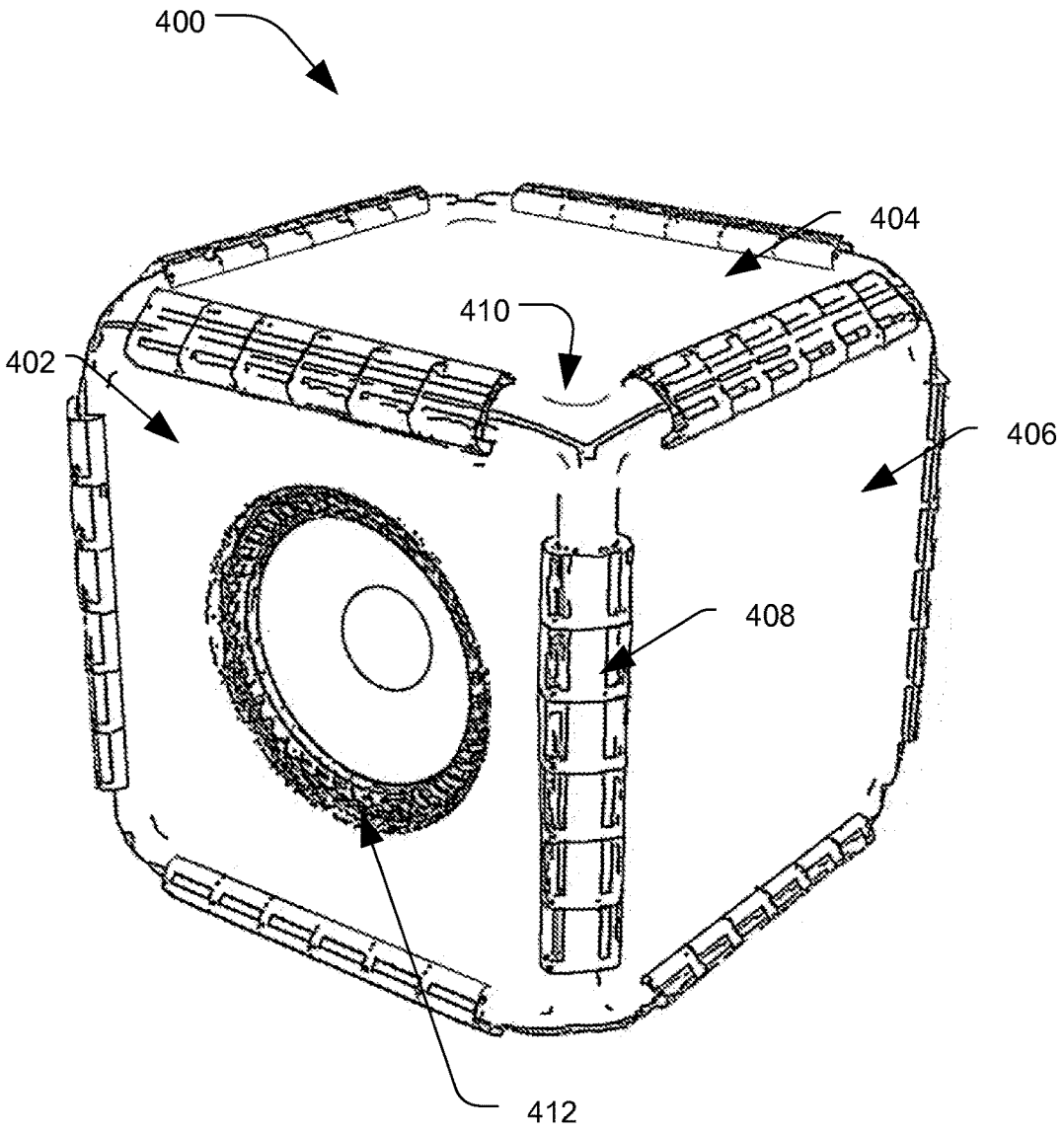
FIG. 4 shows a perspective view a cube audio system, such as is illustrated in FIG. 1.

FIG. 4 shows a perspective view a cube audio system 400, such as is shown in FIG. 1. The system 400 is assembled by a user by fitting panels 402, 404, 406 together using clips 408. Assembly of the panel 402, 404, 406 and clips 408 is facilitated by interior and exterior grooves 410. Panel 402 includes a diaphragm 412. As such, the panel 402 comprises a reciprocating platform that moves linearly in response to changing magnetic fields surrounding an internal voice coil.

Figure 5:
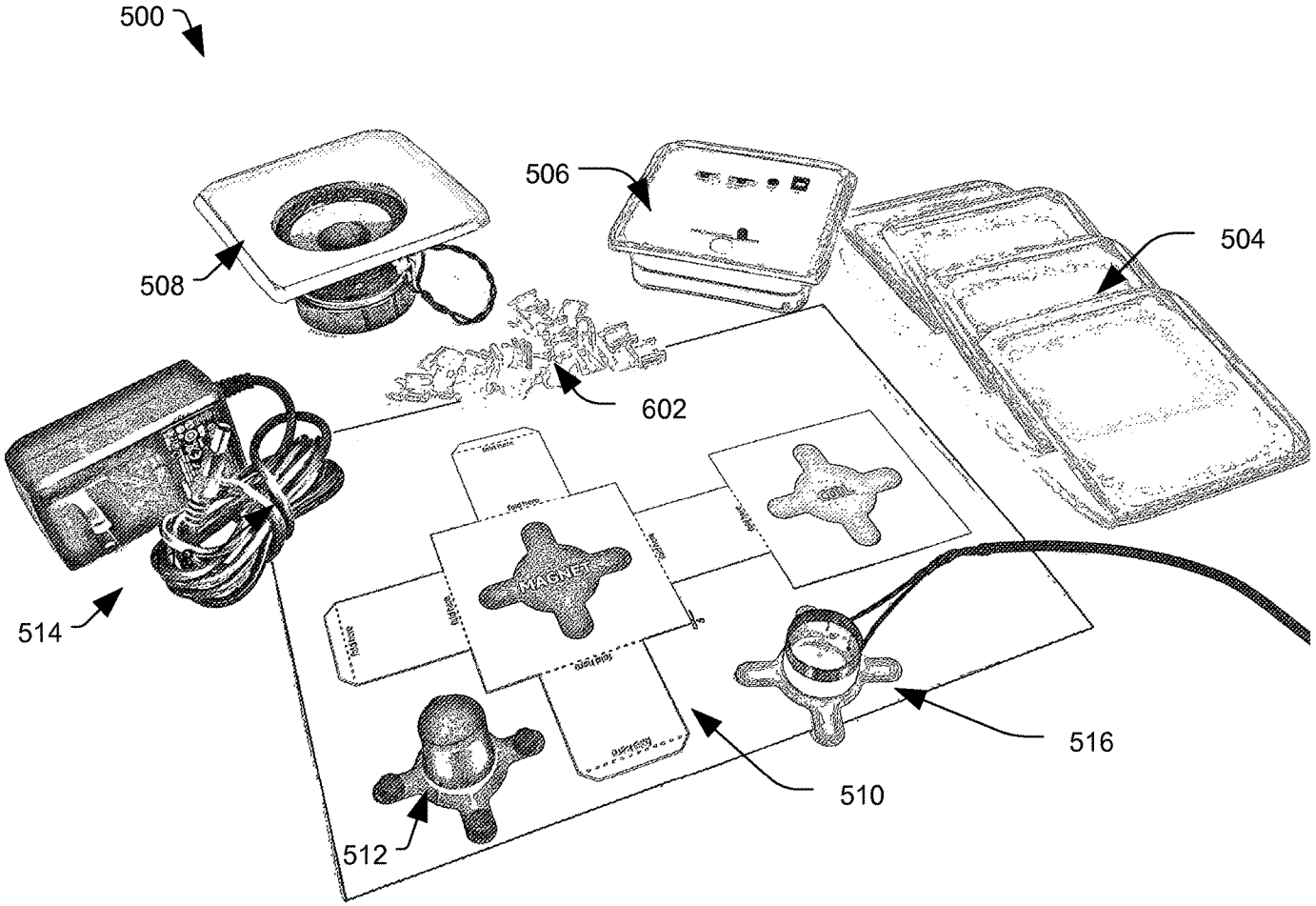
FIG. 5 is a deconstructed view of an audio kit used to assemble the cube audio system of FIG. 4.

FIG. 5 is a deconstructed view of an audio kit 500 used to assemble the cube audio system 400 of FIG. 4. The assembly 500 includes clips 502 used to snap together four panels 504 of the cube audio system. The panels 504 include grooves into which adjacent panels and the clips 502 fit to facilitate assembly. The assembly kit 500 includes a fifth panel portion 506 that includes control circuitry, as well as user input controls (e.g., buttons, switches, and a potentiometer). A diaphragm portion 508 of the assembly kit 500 is connected to the panels 504, 506 according to an instruction sheet 510. A coil assembly 512, a power cord 514, and a magnet assembly 516 are also included in the audio assembly kit 500.

Figure 6:
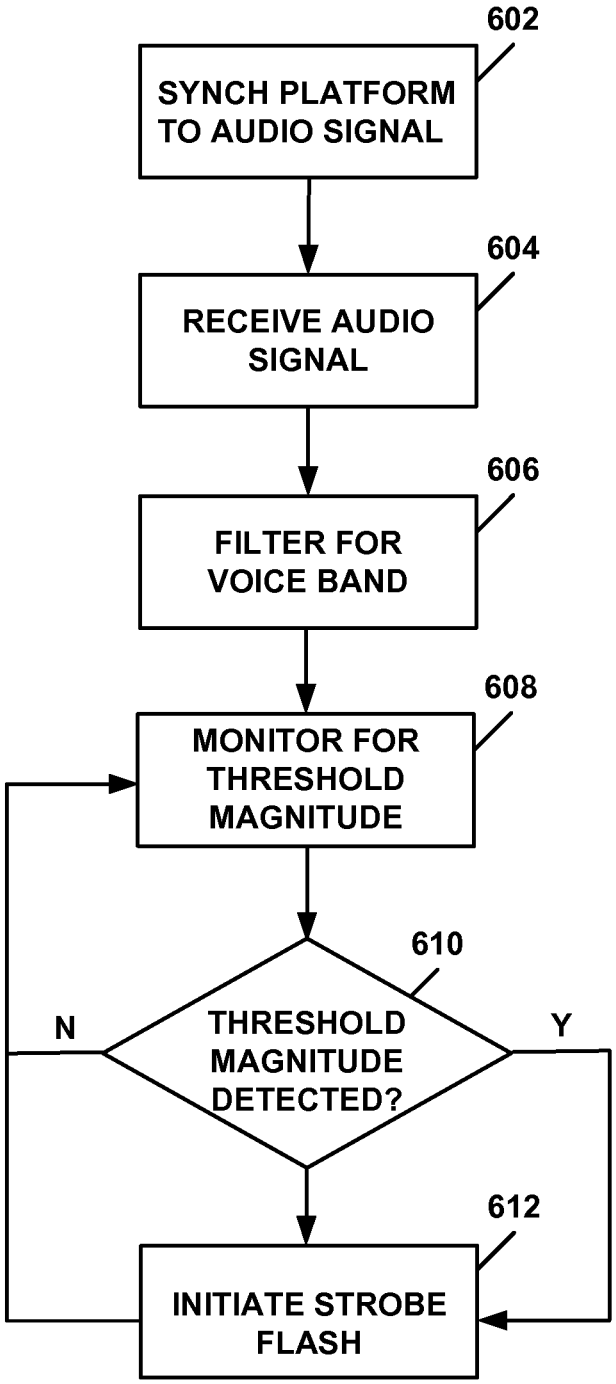
FIG. 6 is a flowchart of a method of controlling a strobe light and audio signal frequency to create an illusion of lip-synching in an inanimate object.

FIG. 6 is a flowchart of a method 600 of controlling a strobe light and audio signal frequency to create an illusion of lip-synching in an inanimate object. Turning to the flowchart, the platform is synchronized at 602 to the audio signal. For instance, the controller correlates the reciprocal movements and motions of the platform to amplitudes of the audio signal. Thus, a given magnitude is associated with a highest point of travel of the platform. Another magnitude is associated with lowest relative position. Still another magnitude is logically linked to a midpoint. The controller uses the associations to initiate strobe flashes at designated (e.g., extreme and midway) points of travel of the platform to create a desired effect. The platform is synchronized to the audio signal by virtue of the diaphragm (in contact with or comprising the platform) being vibrated according to the audio signal.

The audio signal is received at 604. For example, the audio source 210 of FIG. 2 generates and transmits the audio signal to the controller 202. A bandpass filter is used at 606 to reject frequencies of the received audio signal that fall outside of the voice band (i.e., lower than 20 Hz and higher than 20 KHz).

The voice band portion of the audio signal is passed on to the controller and is monitored at 608. For example, the controller of FIG. 2 monitors the voice band frequencies of the audio signal to detect a threshold magnitude. The threshold magnitudes of an example include designated amplitudes selected to create an optimal effect of lip-synchronization. For instance, the amplitudes corresponding to the most extreme points of travel of the platform are selected for maximum exaggerative effect. Intermediary points are selected as threshold magnitudes to further round out a perceived lip movement illusion.

When no threshold magnitude is detected at 610, the system continues monitoring at 608. Alternatively, in response to a threshold magnitude being detected at 610, the controller initiates a strobe flash at 612. The system continues to monitor for a next occurring threshold magnitude at 608 after the flash operation.

Examples described herein may take the form of an entirely hardware implementation, an entirely software implementation, or an implementation containing both hardware and software elements. The disclosed methods are implemented in software that is embedded in processor readable storage medium and executed by a processor that includes but is not limited to firmware, resident software, microcode, etc.

Further, examples take the form of a computer program product accessible from a computer-usable or computer-readable storage medium providing program code for use by or in connection with a computer or any instruction execution system. For the purposes of this description, a computer-usable or computer-readable storage medium includes an apparatus that tangibly embodies a computer program and that contains, stores, communicates, propagates, or transport s the program for use by or in connection with the instruction execution system, apparatus, or device.

In various examples, the medium includes an electronic, magnetic, optical, electromagnetic, infrared, or semiconductor system (or apparatus or device) or a propagation medium. Examples of a computer-readable storage medium include a semiconductor or solid state memory, magnetic tape, a removable computer diskette, a random access memory (RAM), a read-only memory (ROM), a rigid magnetic disc and an optical disc. Current examples of optical discs include compact disc-read only memory (CD-ROM), compact disc-read/write (CD-R/W) and digital versatile disc (DVD).

A data processing system suitable for storing and/or executing program code includes at least one processor coupled directly or indirectly to memory elements through a system bus. The memory elements include local memory employed during actual execution of the program code, bulk storage, and cache memories that may provide temporary or more permanent storage of at least some program code in order to reduce the number of times code must be retrieved from bulk storage during execution. Input/output or I/O devices (including but not limited to keyboards, displays, pointing devices, etc.) of an example are coupled to the data processing system either directly or through intervening I/O controllers. Network adapters are also coupled to the data processing system of the example to enable the data processing system to become coupled to other data processing systems or remote printers or storage devices through intervening private or public networks. Modems, cable modems, and Ethernet cards are just a few of the currently available types of network adapters.

The previous description of the disclosed examples is provided to enable any person skilled in the art to make or use the disclosed examples. Various modifications to these examples will be readily apparent to those skilled in the art, and the generic principles defined herein may be applied to other examples without departing from the scope of the disclosure. Thus, the present disclosure is not intended to be limited to the examples shown herein, but is to be accorded the widest scope possible consistent with the principles and features as defined by the following claims.

What is claimed is:

1. A system comprising:

a strobe light;

a controller in communication with the strobe light, wherein the controller initiates determining a magnitude of a voice band portion of an audio signal, wherein the controller causes the strobe light to flash in response to sensing the magnitude, wherein the flash creates an impression that a mouth of a figure is moving in sequence with the audio signal; and a platform to move vertically in a reciprocating fashion, wherein the strobe light is stationary and flashes in a direction of the platform.

2. The system of claim 1, further comprising filtering the voice band portion from another portion of the audio signal.

3. The system of claim 1, wherein sensing the magnitude further comprises determining that the magnitude exceeds a threshold magnitude.

4. The system of claim 1, wherein the threshold magnitude is one of a plurality of threshold magnitudes each corresponding to a position of the platform.

5. The system of claim 1, wherein the threshold magnitude is preset.

6. The system of claim 1, wherein the threshold magnitude is determined based on relative change in amplitude relative to a previous signal measurement.

7. The system of claim 1, wherein the platform comprises part of a speaker.

8. The system of claim 1, wherein the platform includes a substantially planar surface.

9. The system of claim 1, wherein the platform includes a substantially non-planar surface.

10. The system of claim 1, wherein a figure is configured to at least one of rest on and attach to the platform, wherein the figure is actuated by the platform and illuminated by the strobe to create an impression of movement according to the audio signal.

11. The system of claim 1, wherein the threshold magnitude corresponds to a position of the platform.

12. The system of claim 1, wherein the controller initiates the flash when the platform is at least at one of a relatively high point and a relatively low point of reciprocal motion relative to a base structure.

13. The system of claim 1, wherein the controller initiates a flash when the platform is at an intermediary point of reciprocal motion relative to a base structure.

14. The system of claim 1, further comprising instructions on how to assemble the platform as part of an audio demonstration kit that includes speaker components.

15. A system comprising:

a platform to move vertically in a reciprocal manner;

a stationary strobe light to flash in a direction of the platform; and a controller in communication with the strobe light, wherein the controller determines when to flash the strobe light based on at least one of a magnitude of a measurement of an audio signal and a position of the platform, wherein the flash creates an impression that a mouth of a figure is moving in sequence with the audio signal.

16. The system of claim 15, wherein the movement of the platform in synchronized to the audio signal.

17. The system of claim 15, further comprising a bandpass filter used to pass through a voice band of an audio signal.

18. The system of claim 15, wherein the platform comprises part of a speaker.

19. A system comprising:

a platform to move vertically in a reciprocating fashion, wherein the platform is configured to support a figure having a flexible surface;

a stationary strobe light to flash in a direction of the platform; and a controller in communication with the strobe light, wherein the controller determines when to flash the strobe light based on a magnitude of a measurement of an audio signal, wherein the flash creates an impression that a mouth of the figure is moving in sequence with the audio signal.

20. The system of claim 19, further comprising a bandpass filter used to pass through a voice band of an audio signal.

* * * * *